US006607102B1

(12) United States Patent
Griese et al.

(10) Patent No.: US 6,607,102 B1
(45) Date of Patent: Aug. 19, 2003

(54) RAPID FLOW FITMENT

(75) Inventors: Gregory G. Griese, Hudson, WI (US); Troy A. Anderson, Eagan, MN (US)

(73) Assignee: Ecolab Inc., St. Paul, MN (US)

( * ) Notice: Subject to any disclaimer, the term of this patent is extended or adjusted under 35 U.S.C. 154(b) by 9 days.

(21) Appl. No.: 10/058,811

(22) Filed: Jan. 29, 2002

(65) Prior Publication Data

US 2003/0141316 A1 Jul. 31, 2003

(51) Int. Cl.[7] ..... B67D 5/64
(52) U.S. Cl. ..... 222/173; 141/352; 141/366
(58) Field of Search ..... 222/173, 183, 222/210, 325, 466; 141/351, 352, 363, 364, 366; 68/17 R

(56) References Cited

U.S. PATENT DOCUMENTS

| | | | | |
|---|---|---|---|---|
| 4,328,909 A | | 5/1982 | Jeans | 222/54 |
| 4,408,701 A | | 10/1983 | Jeans | |
| 4,564,132 A | | 1/1986 | Lloyd-Davies | 222/522 |
| 4,570,830 A | | 2/1986 | Jeans | 222/185 |
| 5,086,950 A | | 2/1992 | Crossdale et al. | 222/88 |
| 5,259,423 A | | 11/1993 | Simmel et al. | 141/1 |
| 5,273,083 A | | 12/1993 | Burrows | 141/18 |
| 5,351,859 A | | 10/1994 | Jansen | 222/82 |
| 5,351,860 A | | 10/1994 | Gotoh | 222/83 |
| 5,425,404 A | | 6/1995 | Dyer | 141/351 |
| 5,425,528 A | | 6/1995 | Rains et al. | 251/149.1 |
| 5,431,205 A | * | 7/1995 | Gebhard | 141/351 |
| 5,462,189 A | | 10/1995 | Pierce | 220/254 |
| 5,542,555 A | | 8/1996 | Hidding et al. | 215/265 |
| 5,597,019 A | | 1/1997 | Thomas et al. | 141/18 |
| 5,598,877 A | | 2/1997 | Reidel | 141/346 |
| 5,732,853 A | | 3/1998 | Ganzeboom et al. | 222/82 |
| 5,875,921 A | | 3/1999 | Osgar et al. | 222/1 |
| 5,996,653 A | * | 12/1999 | Piccinino, Jr. | 141/346 |
| 6,109,480 A | | 8/2000 | Monsrud et al. | 222/83 |
| 6,158,486 A | * | 12/2000 | Olson et al. | 141/351 |

OTHER PUBLICATIONS

RD Industries Inc. Brochure; "Introducing the Vent–A–Cap High Capacity Bottle Plug Liquid Delivery System"; Sep. 1998; 2 pgs.

* cited by examiner

*Primary Examiner*—Gene Mancene
*Assistant Examiner*—Patrick Buechner
(74) *Attorney, Agent, or Firm*—IPLM Group, P.A.

(57) ABSTRACT

A liquid dispensing apparatus (10) includes a container (70) for holding a liquid product to be dispensed. A docking station (20) receives the container (70). A reservoir (50) is positioned in the docking station (20) for receiving the liquid to be dispensed. A docking cup is connected to the docking station for opening a bottle insert (90) which is contained in the container (70). The bottle insert includes a body (93) having openings (95). A probe-engaging member is movable between a first and second position without obstructing the openings (95).

23 Claims, 8 Drawing Sheets

FIG. 6
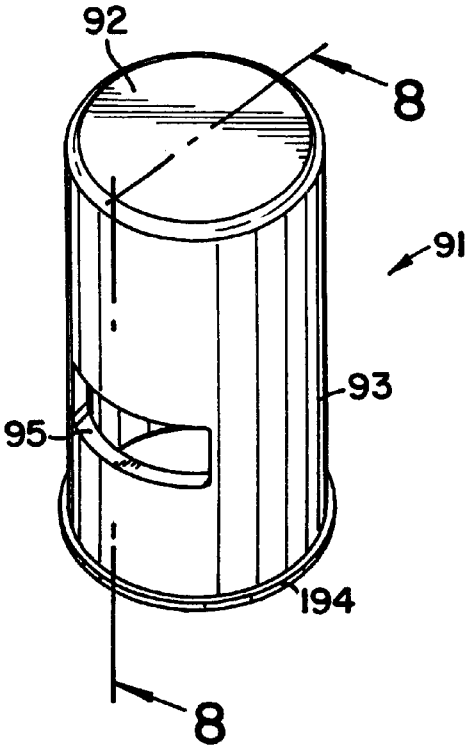
FIG. 8
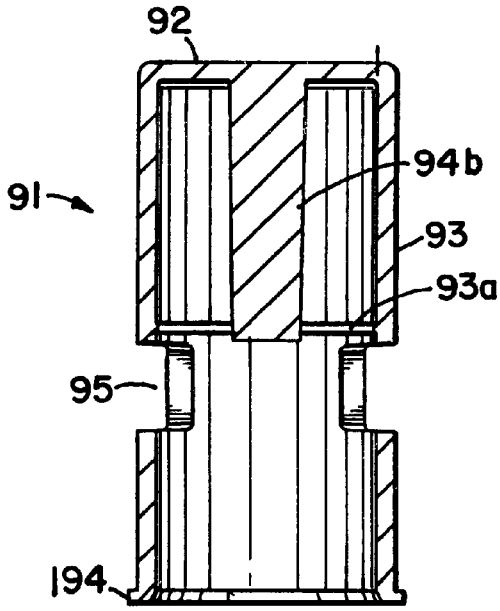
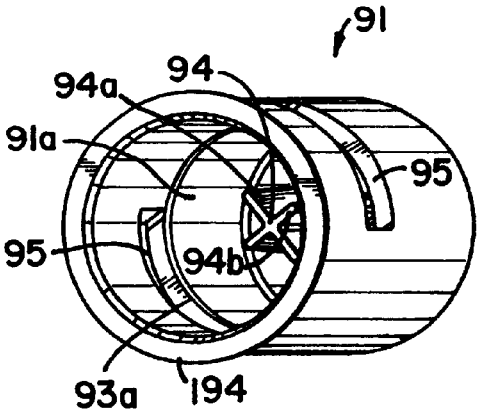
FIG. 7

FIG. 9
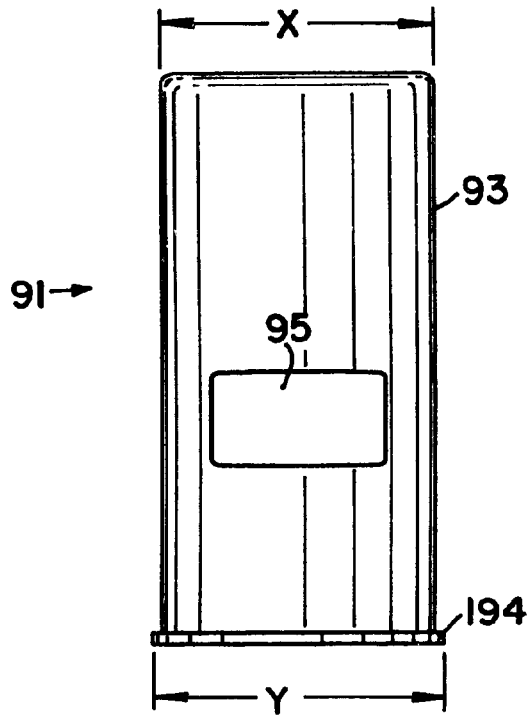
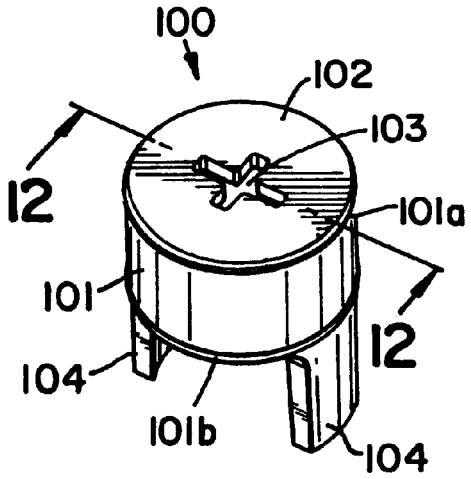
FIG.10

FIG. 11
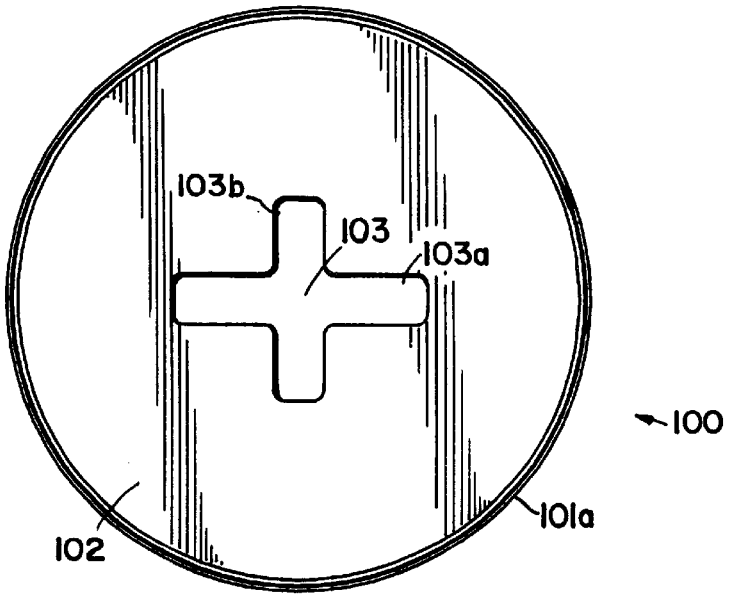
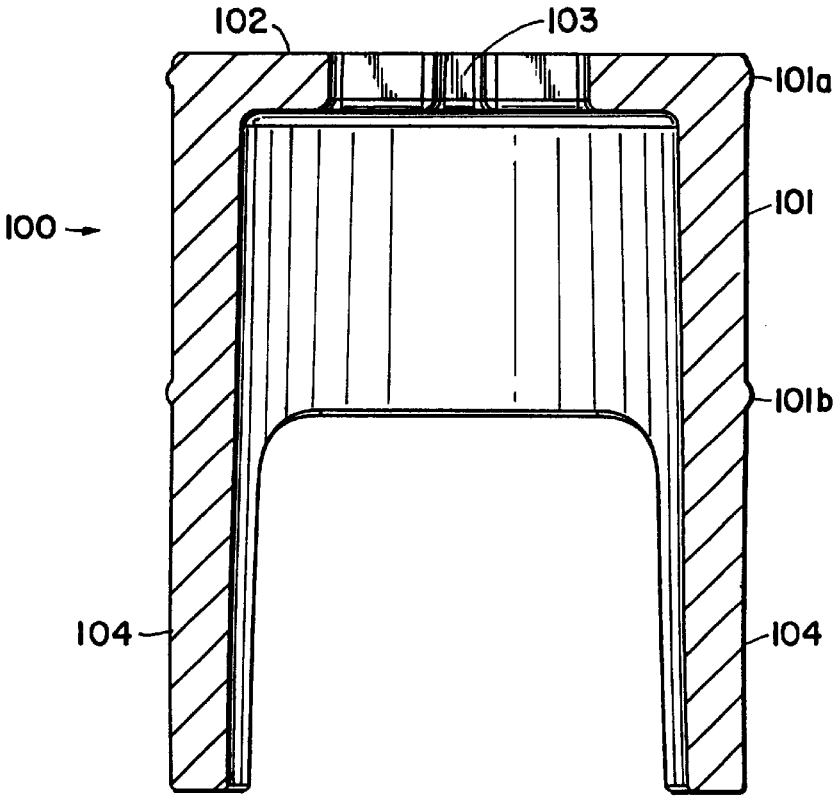
FIG. 12

FIG. 14
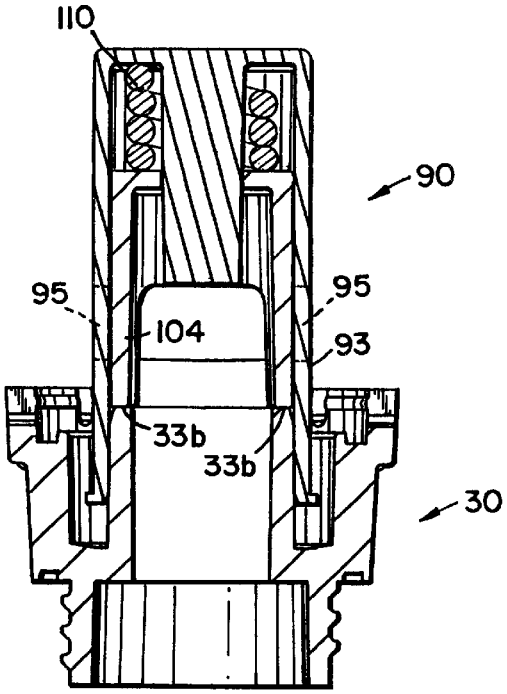
FIG. 13
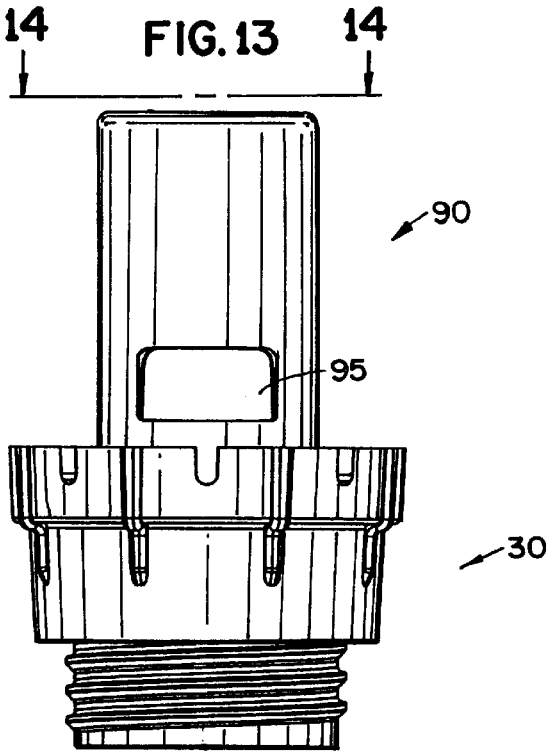
FIG. 13

RAPID FLOW FITMENT

BACKGROUND OF THE INVENTION

1. Field of the Invention

This invention relates generally to a closed package liquid dispensing system and more particularly to a liquid product dispenser including a rapid flow insert for dispensing viscous liquids from bottles.

2. Description of the Prior Art

Many systems have been developed for dispensing a liquid product to an end use such as laundry machines. A goal of a dispensing system is that it be user friendly. That is, the product to be dispensed should be an easy to handle containers, the product can be safely dispensed and provide for various safety features. The dispensing of a viscous liquid is often problematical. Venting is often required, but it is always not desirable to do so. A number of systems have been developed for delivering liquid laundry products, but have fallen short in one or more desired areas. While the present invention is described with respect to the dispensing of liquid laundry products, it is a system that has been designed for broader usage wherever concentrated and potentially corrosive liquid products are handled.

The present invention addresses the features desired in a liquid dispensing system and provides for a rapid flow fitment to be used in the bottle containing a viscous liquid, to allow dispensing without venting.

SUMMARY OF THE INVENTION

In one embodiment, the invention is a liquid dispensing apparatus. A container holds a viscous liquid product to be dispensed. The container has an outlet. A docking station receives the container and has a support for holding the container. A reservoir receives the liquid product from the container, the reservoir having an inlet and an outlet. A docking cup is operatively connected to the docking station. The docking cup has an inlet adapted to receive the outlet of the container and the docking cup having an outlet operatively connected to the inlet of the reservoir. The docking cup having a fitment engagement member. A fitment is operatively connected in the outlet of the container. The fitment has a body having an inner wall defining a bore. The bore has a first closed end and a second open end. The open end is proximate the container outlet and the first end is positioned inward, into the container. An aperture is formed in the body, the aperture in fluid communication with the viscous liquid product to be dispensed. A plunger has a body slidable within the fitment body and is moveable between a closed position and a dispensing position. A probe engaging member is operatively connected to the plunger body. The probe engaging member is proximate the inner wall, thereby having the bore be unobstructed, wherein placing the container on the docking cup moves the plunger from the closed position to the open position, allowing the viscous product to be dispensed.

In another embodiment, the invention is a liquid dispensing apparatus having a container for holding a viscous liquid product to be dispensed. The container has an outlet. A docking station receives the container and has a support for holding the container. A reservoir receives the viscous liquid product from the container. The reservoir has an inlet and an outlet. A docking cup is operatively connected to the docking station, the docking cup having an inlet adapted to receive the outlet of the container and the docking cup having an outlet operatively connected to the inlet of the reservoir. The docking cup has a fitment engagement member. A fitment is operatively connected in the outlet of the container. The fitment has a cylindrical body having an inner wall defining a cylindrical bore. The cylindrical bore has a first closed end and a second open end, the open end proximate the container outlet. An aperture is formed in the body. The aperture is in fluid communication with the viscous liquid product to be dispensed. A plunger has a cylindrical body slidable within the fitment cylindrical body and is moveable between a closed position and a dispensing position. A probe engaging member is operatively connected to the cylindrical plunger body. The probe member is positioned whereby there is an unobstructed flow path for the viscous liquid from the container, through the aperture, and through the bore to the inlet of the reservoir, wherein placing the container on the docking cup moves the plunger from the closed position to the open position allowing the viscous product to be dispensed. A biasing member is positioned between the plunger and the closed end, thereby biasing the plunger in the closed position.

In another embodiment, the invention is a container having a dispensing fitment for use with a docking station. The docking station receives and supports the container and the docking station having a probe to contact the dispensing fitment. The container includes a container body for holding a viscous liquid product to be dispensed. The container has an outlet. A fitment is operatively connected in the outlet of the container. The fitment has a body having an inner wall defining a bore. The bore has a first closed end and a second open end. The open end is proximate the outlet and the first end is positioned inward, into the container. An aperture is formed in the body. The aperture is in fluid communication with the viscous liquid product to be dispensed. A plunger has a body slidable within the fitment body and moveable between a closed position and a dispensing position. The probe engaging member is operatively connected to the plunger body. The probe engaging member is proximate the inner wall, thereby having the bore be unobstructed, wherein placing the container on the probe moves the plunger from the closed position to the open position, allowing the viscous product to be dispensed through the probe.

In another embodiment, the invention is a container having a dispensing fitment for use with a docking station. The docking station receives and supports the container and the docking station having a probe to contact the dispensing fitment. The container includes a container body for holding a viscous liquid product to be dispensed. The container has an outlet. A fitment is operatively connected in the outlet of the container. The fitment has a cylindrical body having an inner wall defining a cylindrical bore. The bore has a first closed end and a second open end. The open end is proximate the container outlet. An aperture is formed in the body. The aperture is in fluid communication with the viscous liquid product to be dispensed. A plunger has a cylindrical body slidable within the fitment cylindrical body and moveable between a closed position and a dispensing position. A probe engaging member is operatively connected to the cylindrical plunger body. The probe member is positioned whereby there is an unobstructed flow path for the viscous liquid from the container, through the aperture and through the bore to the inlet of the reservoir, wherein placing the container on the probe moves the plunger from the closed position to the open position, allowing the viscous product to be dispensed through the probe. A biasing member is positioned between the plunger and closed end, thereby biasing the plunger in the closed position.

BRIEF DESCRIPTION OF THE DRAWINGS

FIG. 6 is a perspective view, shown generally from below, of the outer cylinder of the rapid flow fitment of the present invention;

FIG. 7 is a perspective view, viewed generally from above, of the cylinder shown in FIG. 6;

FIG. 8 is a cross-sectional view of the cylinder shown in FIG. 6, taken generally along the lines 8—8;

FIG. 9 is a front elevational view of the cylinder shown in FIG. 6;

FIG. 10 is a perspective view, shown generally from above, of the plunger used in the rapid flow fitment of the present invention;

FIG. 11 is a top plan view of the plunger shown in FIG. 10;

FIG. 12 is a cross-sectional view, taken generally along the lines 12—12 of the plunger shown in FIG. 10;

FIG. 13 is a front elevational view of the rapid flow fitment in a docked position in the docking cup;

FIG. 14 is a cross-sectional view of the rapid flow fitment shown in FIG. 13, taken generally along the lines 14—14.

DETAILED DESCRIPTION OF THE PREFERRED EMBODIMENT

Figure 1:
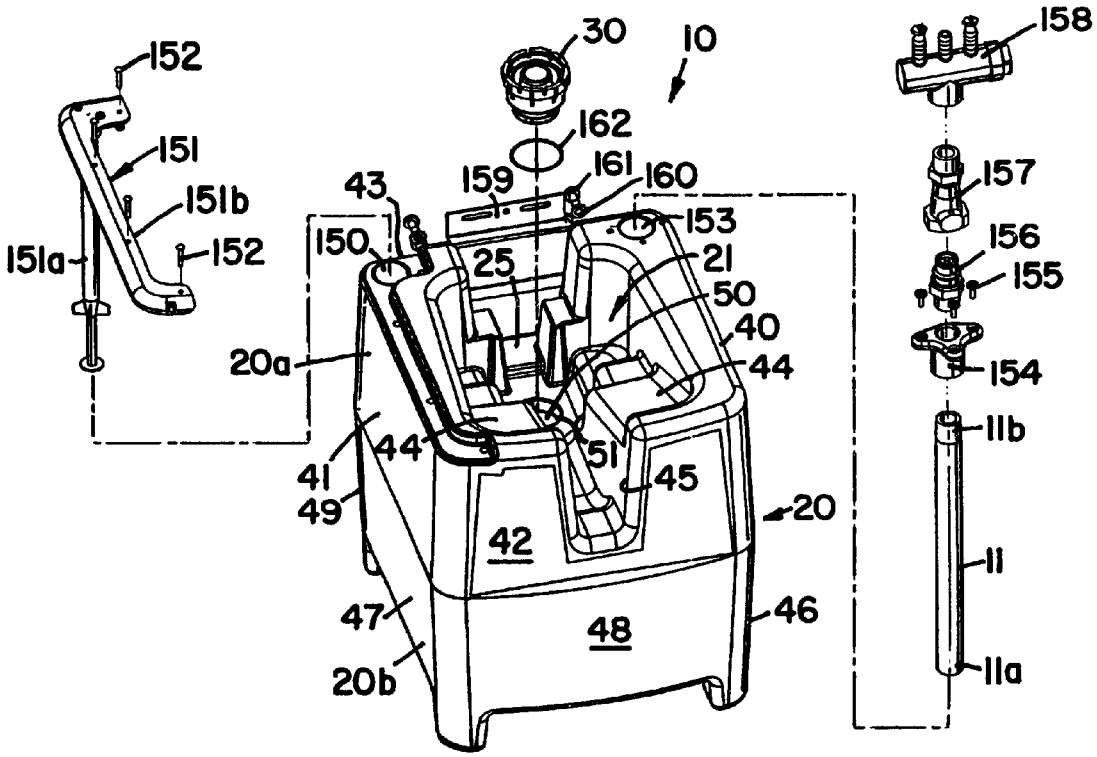
FIG. 1 is an exploded perspective view showing the docking station of the present invention.
Figure 2:
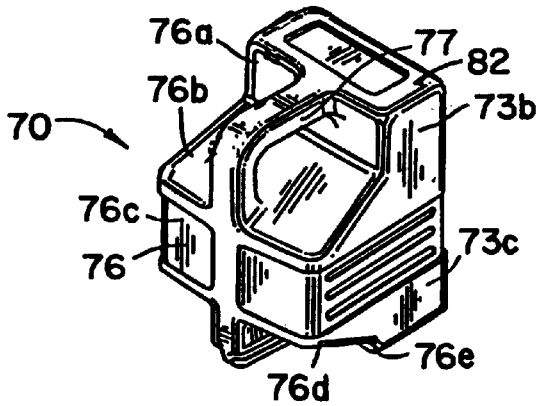
FIG. 2 is a perspective view of the container of the present invention.
Figure 3:
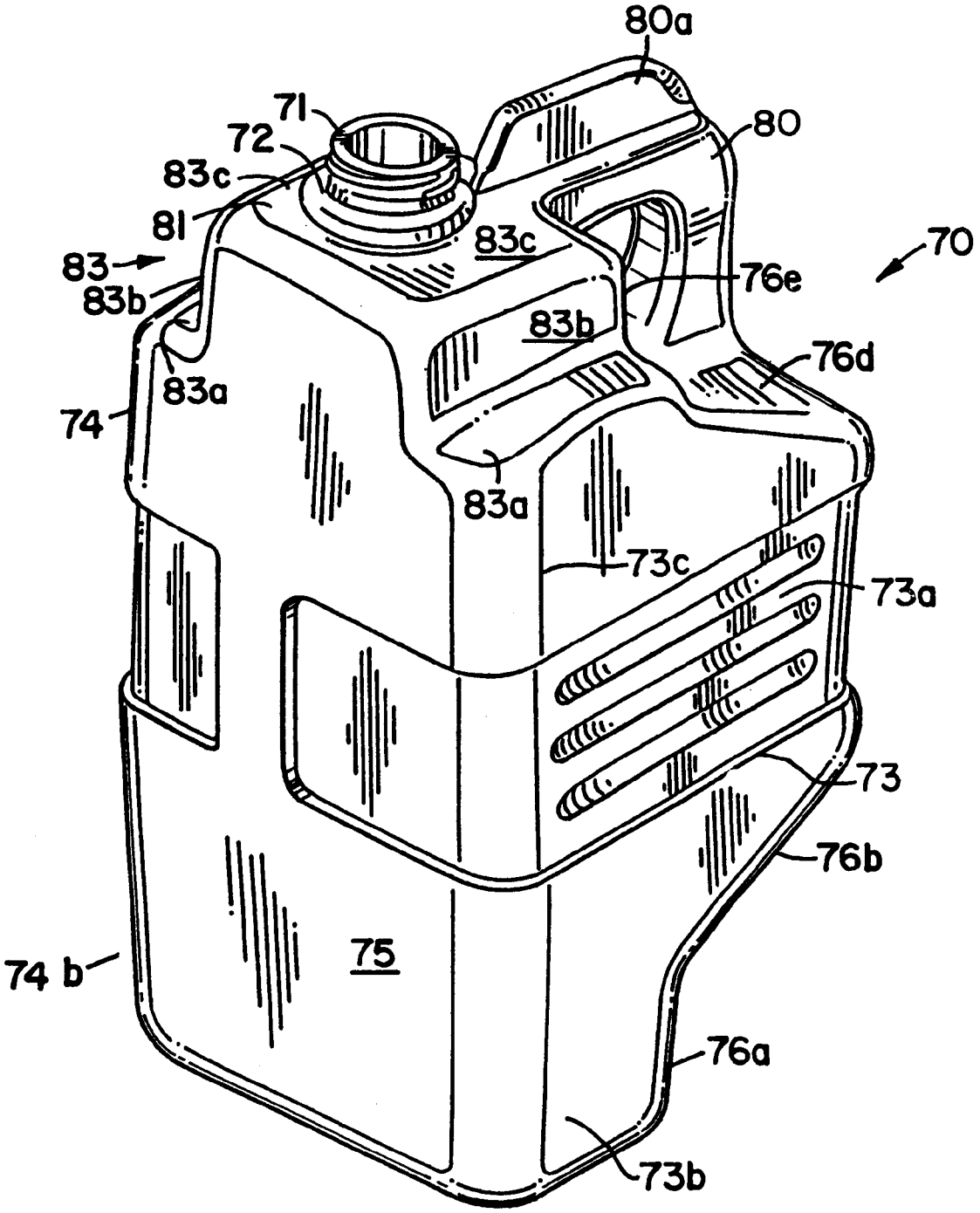
FIG. 3 is a perspective view of the container shown in FIG. 1.

Referring to the drawings, wherein like numerals represent like parts throughout the several views, there is generally shown at 10 a liquid dispensing system. The liquid dispensing system 10 is similar to the liquid dispensing system described in U.S. Pat. No. 6,158,486 which is hereby incorporated by reference. The docking cup 30 and bottle insert 90 have been modified for better dispensing of viscous liquids. Further, the containers do not need a vent because of the rapid flow fitment. Also, the reservoir of U.S. Pat. No. 6,158,486 is no longer a separate piece, although it still could be separate.

The liquid dispensing system 10 includes a docking station 20 that has a docking cup 30 mounted therein. A reservoir 50 has its inlet 51 in fluid communication with the docking cup 30. The docking station 20 has a cavity 21 which is sized and configured to receive the container 70.

The docking station is shown in FIG. 1. The docking station 20 includes an upper section 20*a* and a bottom section 20*b*. The upper section 20*a* has a right sidewall 40 connected to a left sidewall 41 by a front wall 42 and a rear wall 43. The walls 40–43 define an inner cavity 21. The inner cavity 21 is sized and configured to receive the container 70 as described in U.S. Pat. No. 6,158,486. The inner cavity 21 has two sloped surfaces 44 which has a slot 45 formed between them. The surface 25 forms the bottom of the cavity 21. The two sloped surfaces 44 are proximate the front wall 42. The sloped surfaces 44 trends generally downward as they go towards the rear wall 43. Proximate the rear wall 43 is formed a mating indentation for the lockout feature of the container 70.

The bottom section 20*b* is formed by right sidewall 46 and left sidewall 47 being operatively connected by the front wall 48 and rear wall 49. The walls 46–49 and a bottom (not shown) define the reservoir 50.

A first opening 150 is formed in the docking station and extends into the reservoir 50. A suitable low level indicator assembly 151 is positioned in the reservoir 50 to indicate when the product to be dispensed is at a low level. The low level indicator assembly 151 includes a sensing section 151*a* and a mounting section 151*b*. The mounting section 151*b* is secured by suitable means such as screws 152. Another opening 153 is formed in the docking station 20 and extends into the reservoir 50. A pick-up tube 11 is inserted in the opening 153. The pick-up tube 11 is the outlet for the reservoir 50, it being understood other suitable outlets may be used. A first end 11*a* is positioned adjacent the bottom of the reservoir 50 and is utilized to pick up the product that has been emptied from the container 70 into the reservoir 50. The second end 11*b* is secured to a coupling 154 which is mounted to the top of the docking station 20 by suitable means such as screws 155. As is well known in the art, a quick coupling insert 156 is positioned in the coupling 154 and a quick coupling body with a shut-off 157 is operatively connected to the insert 156. A manifold 158 is operatively connected to the body 157. Appropriate connections (not shown) are then connected to the manifold 158 to bring the liquid being dispensed to the desired position by a suitable pump such as a peristaltic pump or other suitable means. The manifold 158 is optional but does allow the product in the reservoir 50 to be dispensed more than one location. A mounting bracket 159 is secured to the docking station 20 by suitable means such as block washers 160 and screws 161. The mounting bracket 159 may then be used to mount the docking station 20 to a wall or other suitable surface. An 0-ring seal 162 is positioned between the docking cup 30 and the docking station 20.

Figure 4:
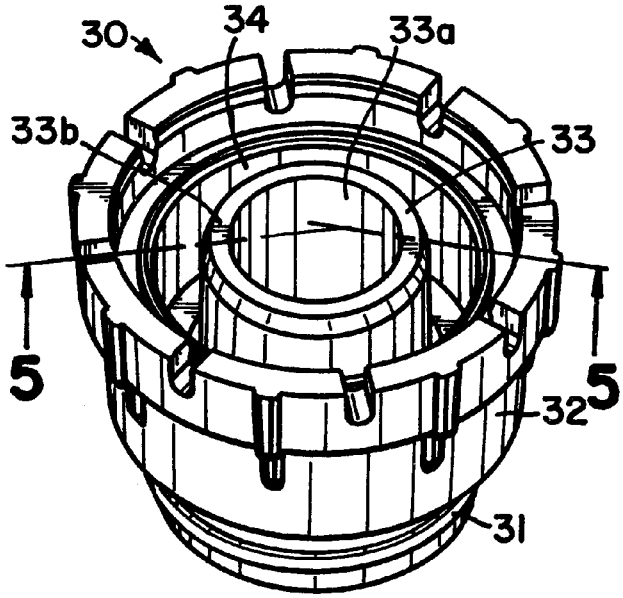
FIG. 4 is a perspective view of the docking cup used in the dispenser shown in FIG. 1.
Figure 5:
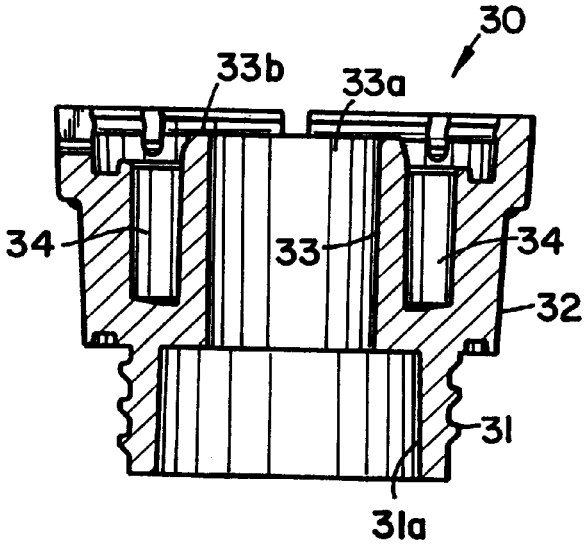
FIG. 5 is a cross-sectional view taken generally along the lines 5—5 of the docking cup shown in FIG. 4.

The docking cup 30 (as will be described more fully hereafter) is threaded into the inlet 51 of the reservoir 50. The docking cup 30 is therefore in fluid communication with the cavity of the reservoir 50. The docking cup 30 is best seen in FIGS. 4 and 5. The docking cup 30 is generally cylindrical in shape and has a threaded base 31 operatively connected to a cylindrical outer member 32. Positioned inside of the cylindrical outer member 32 is a probe (or plunger engaging member) 33. Preferably, the threaded base 31, cylindrical outer member 32 and probe 33 are an integral one-piece member. The probe 33 has a central bore 33*a* through which liquid may pass. The bore 33*a* is in fluid communication with the bore 31*a* of the base 31. Liquid is therefore able to flow through the docking cup bores 31*a*, 33*a* into the reservoir tank 50. The probe 33 has a plunger engaging surface 33*b* that is beveled at its outer edge. The bevel allows for easier alignment of the rapid flow fitment 90 as will be described more fully hereafter. A circular cavity 34 is formed between the outer walls of the probe 33 and the inner wall of the outer member 32. The cavity 34 provides for an area for the fitment 90 to move. It is understood that any suitable docking cup 30 or docking station 20 may be utilized. It is recognized that the probe 33 is what is necessary to cooperate with the rapid flow fitment 90 to utilize the present invention. The docking cup could be as simple as a cylindrical probe to cooperate with the rapid flow fitment 90. Also, other suitable docking station or container may be used to incorporate the rapid flow insert 90 of this invention.

The container 70 has a threaded outlet 71. A circular lip 72 is formed around the outlet at the base of the threads. A rapid flow fitment or bottle insert, generally designated at 90, is secured in the interior of the outlet 71. The rapid flow fitment 90 is best seen in FIGS. 6–14. The fitment 90 includes a generally cylindrical outer member 91, as shown in FIGS. 6–9 and a plunger 100, as shown in FIGS. 10–12. The fitment 90 also includes a compression spring 110, shown in FIG. 14.

Referring now to FIGS. 6–9, the cylindrical outer member 91 is in the general shape of a cylinder having a closed base 92. The sidewall 93 is circular and is operatively connected to the base 92. The sidewall 93 has a slight taper. That is, the distance X at its base is 1.22 inches and the distance Y at its top is 1.300 inches. There is a slight radius which connects the base 92 to the sidewall 93. The taper allows for easier insertion into the container 70. At the top is a rim 194 which engages the outlet 71. Approximately mid-way on the inner surface of the sidewall 93 is formed a ring 93*a* which extends completely around the interior of the sidewall 93 and is used for a snap lock, as will be described more fully hereafter. A plunger guide 94 extends from the base 92 towards the top. The plunger guide 94 is in the shape of a cross and has a longer first leg 94*a* and a shorter cross leg 94*b*. Two openings, or windows, 95 are formed in the sidewall 93. The openings 95 are symmetrical and are positioned 180 degrees from each other. The windows are sized approximately 0.783 inches by 0.420 inches each. The bore 91*a* extending through the member 91 has a closed top end, defined by base 92 and an open bottom end.

A piston or plunger 100 is shown in FIGS. 10–12. The plunger 100 is sized and configured to be slidable inside of the cylindrical member 91. The plunger 100 has a cylindrical sidewall 101 operatively connected to a base 102. The base 102 has a cross-shaped opening 103 that is sized and configured to match with the plunger guide 94. That is, the opening 103 has a first elongate slot 103*a* which is sized and configured to receive leg 94*a* and a second slot 103*b* which is sized and configured to receive second leg 94*b*. The combination of the opening 103 and guide 94 ensure that the plunger is inserted in the correct orientation so that the windows 95 are not obstructed by legs 104. Proximate the base 102 and sidewall 101 is a first snap ring protuberance 101*a*. A second snap ring protuberance 101*b* is positioned approximately halfway down the sidewall 101. The protuberances 101*a*, 101*b* cooperate with the ring 93*a* as will be described more fully hereafter. The plunger 100 has two elongate probe engaging members or legs 104. The legs 104 have a width of approximately 0.375 inches. The legs are positioned 90 degrees from the openings 95 so as not to obstruct the openings 95. The width of the legs is such that it is less than the distance between the openings 95 so as not to interfere with the dispensing of liquid, as will be described more fully hereafter.

The container 70 may be formed by any suitable process such as blow molding. The container 70 is a dual-handled container. The container 70 has two sidewalls 73 and 74 that are mirror images of each other. The sidewalls have a central section 73*a*, upper section 73*b* and lower section 73*c*. The upper and lower sections 73*b* and 73*c* extend upward and downward respectively from the back of the sidewalls. A generally rectangular back wall 75 connects the back of the sidewalls 73 and 74. The front wall 76 has a first generally vertical section 76*a* connected to a sloped section 76*b* which is in turn connected to a horizontal section 76*c*. The horizontal section 76*c* is connected to a sloped surface 76*d* which is in turn connected to a generally vertical section 76*e*. The front walls 76 connects the front end of the sidewalls 73 and 74. A first handle 77 is formed at one end of the container 70. The handle 77 has one end connected to the front wall 76*a* and the other end connected to the front wall 76*b*. A second handle 80 is connected between the front wall 76*d* and front wall 76*e*. A threaded outlet 71 is formed top 81. The outlet 71 has threads on the outside on which a cap (not shown) is secured. The container also has a bottom 82 which is connected between the upper sections 73*b* and 74*b*. It should be appreciated that reference to the top 82 and bottom 81 is relative depending upon which way the container is turned. The second handle 80 has an extension 80*a* which is solid and extends beyond the end of the outlet 71. This provides protection in case the bottle is dropped when being held by the first handle.

Proximate the outlet 71 is formed a lockout feature 83. The lockout feature 83 is sized to mate with the mating indentation formed in the docking station 20. The lockout feature 83 includes a first horizontal section 83*a* connected to a second horizontal section 83*b* by vertical section 83*c*. A mirror image configuration is formed on the other side of the outlet cup. Section 83*a* will come to rest on horizontal surface 150 and section 83*b* will rest on horizontal section 151. The width and length of the lockout feature match the width and length of the mating indentation. The sloped surface 76*d* rests on the sloped surface 44 when the container 70 is inserted in the docking station 20. It is also understood that any suitable container 70 may be utilized as long as there is an opening to accept the rapid flow fitment 90.

Referring to FIGS. 13 and 14, the assembled fitment 90 is shown in a docking position in the docking cup 30. The container 70 has been removed for clarity. However, it is understood that the fitment 90 is inserted and secured in inlet 71 of the container 70 as described and is similar to that shown in U.S. Pat. No. 6,158,486, that is, there may be a press fit between the fitment 90 and the container and/or spin welding may also be used to further secure the fitment 90. In assembling the fitment 90, the spring 110 is placed inside of the cylinder 91 proximate the base 92. Then, the plunger 100 is inserted into the cylinder 91. The opening 103 matches up with the plunger guide 94 and the plunger is depressed further toward the base 92. The first protuberance 101*a* is pushed past ring 93*a*. The ring 93*a* and protuberance 101*a* are sized so that the force of the spring 110 cannot force the plunger 100 past the ring 93*a*, thereby holding the plunger 100 in place in the cylindrical member 91. The second protuberance 101*b* is utilized to restrict movement of the plunger 100 into the cylindrical member 91, by limiting the movement so that the protuberance 101*b* does not pass the ring 93*a*. The protuberances 101*a*, 101*b* also act as seals.

In use, the liquid dispensing system 10 provides for safe and easy-to-use liquid product storage and application. The container 70 is shipped in boxes with the outlet 71 facing upward. The container 70, in this position, is easily handled by grasping the first handle 77. When the product inside of the container 70 is needed for the liquid dispensing system 10, the first handle 77 is grasped to lift out the container 70. Then, the cap (not shown) is removed. Then, the container is inverted for use in the liquid dispensing system 10. Upon inverting, the second handle 80 is used to grasp the container 70. The container 70, with the outlet 71 pointing downward, is then brought to the docking station 20. The container 70 is positioned over the docking cup 30 and lowered into position. The lockout feature of the container has to match with the lockout indentation of the reservoir in order for the outlet 71 to come into contact with the docking cup 30. The use of different lockout shapes can be utilized to prevent the dispensing of wrong product in a liquid dispensing system. The product and reservoir may also be color-coded to provide another level of identification of the correct product.

Figure 15:
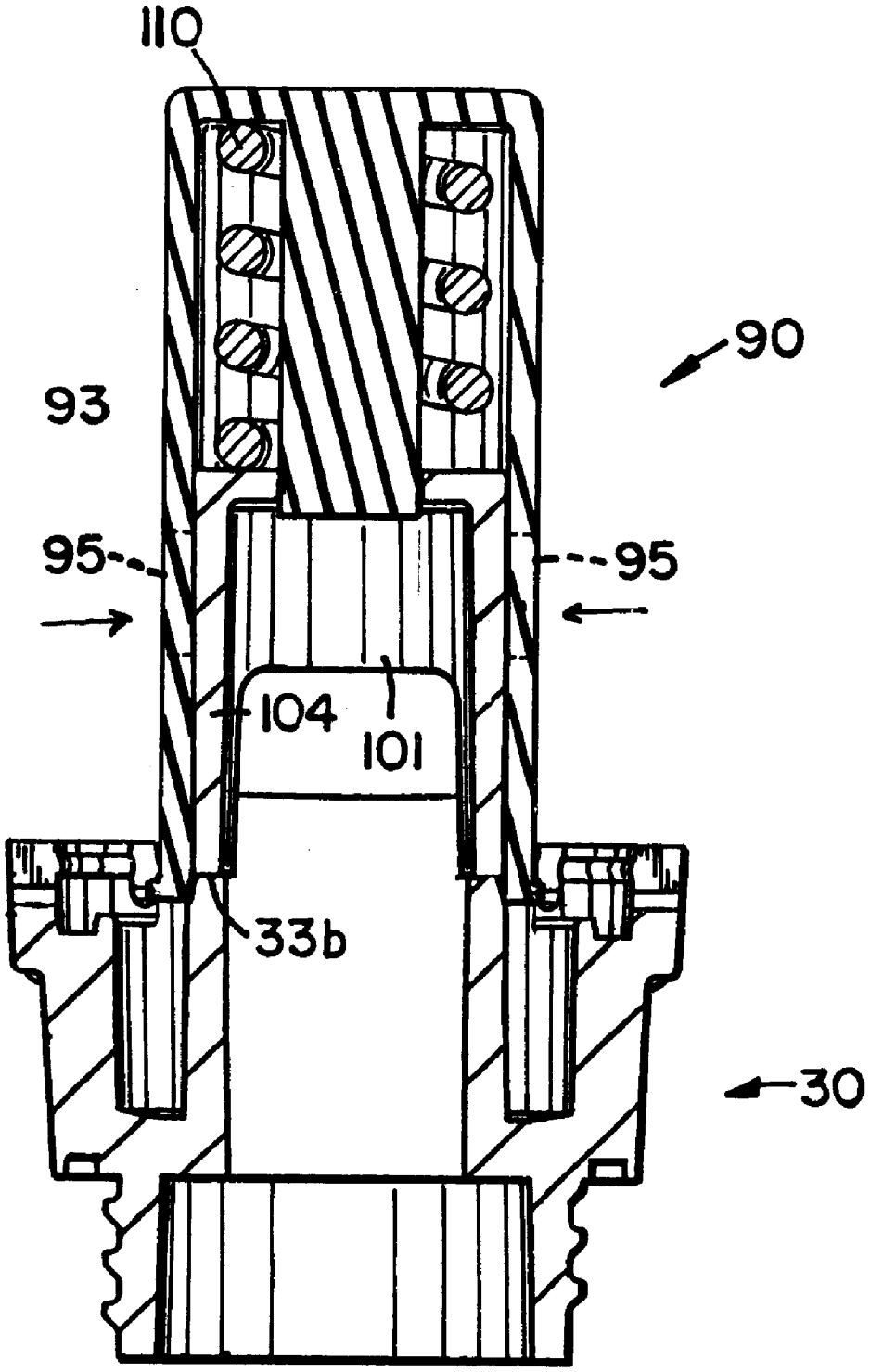
FIG. 15 is a cross-sectional view of the fitment shown in FIG. 14, but in an undocked position.

The sequence of steps in inserting the container 70 into the docking cup 30 is shown in FIGS. 14 and 15. The position shown in FIG. 15 is that of the container 70 just prior to contacting the docking cup 30. In this position, the spring 110 is pushing the base 102 downward, thereby placing the sidewall 101 in front of the windows 95, thereby preventing the dispensing of product. The arrows in FIG. 15 show the position of the product flow inside of the container 70. However, because the plunger 100 is covering the windows 95, the product is not able to flow outside of the container 70 or through the bore 91*a*. Any product in container 70 must flow through the windows 95 to be dispensed.

Now, referring to FIG. 14, the container 70 has now been placed on to the docking cup 30. The probe 33 of the docking cup 30 has contacted the legs 104 and has moved the plunger guide 94 upward and compressed the spring 110. This moves the sidewall 101 of the plunger 100 away from the windows 95 and allows for the liquid in the container 70 to go through the window 95 and into the bore 91*a* and then downward into the reservoir 50. The bore 91*a* is an unobstructed passageway for the liquid to be dispensed. Therefore, the highly viscous liquid to be dispensed is able to flow through the bore 91. If there were obstructions, this would make the flow of the viscous liquid difficult or impossible. The legs 104 are adjacent the cylindrical walls and are not obstructing flow through the bore 91*a*. Further, the legs are in an orientation which are 90 degrees from the windows 91, thereby allowing free flow through the windows 95. The product would then empty into reservoir 50 until reservoir 50 was full. The remaining product, if any, would then "chicken feed" into reservoir 50 to replace the product dispensed by the pumps.

If a snap fit or other retaining means between the container 70 and docking cup 30 were not used, the spring 110 would tend to push the container 70 away from the docking cup as product was dispensed. At some point, the weight of the product would not be sufficient to overcome the biasing force of the spring and the container would move off of the docking cup 30. The snap fit between the docking cup and the container prevents this from occurring.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A container having a dispensing fitment, for use with a docking station, the docking station receiving and supporting the container and the docking station having a probe to contact the dispensing fitment, the container comprising:

a) a container body for holding a viscous liquid product to be dispensed, the container having an outlet; and b) a fitment operatively connected in the outlet of the container, the fitment comprising:

i) a body having an inner wall defining a bore having a first closed end and a second open end, the open end proximate the container outlet and the first end positioned inward, into the container;

ii) an aperture formed in the body, the aperture in fluid communication with the viscous liquid product to be dispensed;

iii) a plunger having a body slidable within the fitment body and moveable between a closed position and a dispensing position; and iv) a probe engaging member operatively connected to the plunger body, the probe engaging member proximate the inner wall, thereby having the bore be unobstructed, wherein placing the container on the probe moves the plunger from the closed position to the open position allowing the viscous product to be dispensed through the probe.

2. The container of claim 1, wherein the body is cylindrical, the bore is cylindrical and plunger body is cylindrical.

3. The container of claim 2, the aperture comprises first and second windows generally opposite each other on the cylindrical body and the probe engaging member comprises first and second legs, generally opposite each other and oriented to be positioned between the windows.

4. The container of claim 3, further comprising a keyed extension extending from the closed end of the bore and a mating keyway formed in the plunger, wherein the plunger is properly oriented in the bore so that the legs do not cover the windows and wherein the keyed extension comprises first and second members, the first member longer than the second member.

5. The container of claim 4, further comprising a biasing member positioned between the plunger and the closed end, thereby biasing the plunger in the closed position.

6. A container having a dispensing fitment, for use with a docking station, the docking station receiving and supporting the container and the docking station having a probe to contact the dispensing fitment, the container comprising:

a) a container body for holding a viscous liquid product to be dispensed, the container having an outlet;

b) a fitment operatively connected in the outlet of the container, the fitment comprising:

i) a cylindrical body having an inner wall defining a cylindrical bore having a first closed end and a second open end, the open end proximate the container outlet;

ii) an aperture formed in the body, the aperture in fluid communication with the viscous liquid product to be dispensed;

iii) a plunger having a cylindrical body slidable within the fitment cylindrical body and moveable between a closed position and dispensing position; and iv) a probe engaging member operatively connected to the cylindrical plunger body, the probe member positioned whereby there is an unobstructed flow path for the viscous liquid from the container, through the aperture and through the bore to the inlet of the reservoir, wherein placing the container on the probe moves the plunger from the closed position to the open position allowing the viscous product to be dispensed through the probe; and c) a biasing member positioned between the plunger and the closed end, thereby biasing the plunger in the closed position.

7. The container of claim 6, the aperture comprises first and second windows generally opposite each other on the cylindrical body and the probe engaging member comprises first and second legs, generally opposite each other and oriented to be positioned between the windows.

8. The container of claim 7, further comprising a keyed extension extending from the closed end of the bore and a mating keyway formed in the plunger, wherein the plunger is properly oriented in the bore so that the legs do not cover the windows and wherein the keyed extension comprises first and second members, the first member longer than the second member.

9. The container of claim 8, further comprising a biasing member positioned between the plunger and the closed end, thereby biasing the plunger in the closed position.

10. A liquid dispensing apparatus, comprising:

a) a container for holding a viscous liquid product to be dispensed, the container having an outlet;

b) a docking station for receiving the container, the docking station having a support for holding the container;

c) a reservoir for receiving the viscous liquid product from the container, the reservoir having an inlet and an outlet;

d) a docking cup operatively connected to the docking station, the docking cup having an inlet adapted to receive the outlet of the container and the docking cup having an outlet operatively connected to the inlet of the reservoir, the docking cup having a fitment engagement member; and e) a fitment operatively connected in the outlet of the container, the fitment comprising:

i) a body having an inner wall defining a bore having a first closed end and second open end, the open end proximate the container outlet and the first end positioned inward, into the container;

ii) an aperture formed in the body, the aperture in fluid communication with the viscous liquid product to be dispensed;

iii) a plunger having a body slidable within the fitment body and moveable between a closed position and a dispensing position; and iv) a probe engaging member operatively connected to the plunger body, the probe engaging member proximate the inner wall, thereby having the bore be unobstructed, wherein placing the container on the docking cup moves the plunger from the closed position to the open position allowing the viscous product to be dispensed.

11. The apparatus of claim 10, wherein the body is cylindrical, the bore is cylindrical and plunger body is cylindrical.

12. The apparatus of claim 10, further comprising a biasing member positioned between the plunger and the closed end, thereby biasing the plunger in the closed position.

13. The apparatus of claim 10, the aperture comprises first and second windows generally opposite each other on the cylindrical body.

14. The apparatus of claim 13, the probe engaging member comprises first and second legs, generally opposite each other and oriented to be positioned between the windows.

15. The apparatus of claim 14, wherein the legs have a width that is less than a distance between the window, whereby the windows are unobstructed.

16. The apparatus of claim 15, further comprising a keyed extension extending from the closed end of the bore and a mating keyway formed in the plunger, wherein the plunger is properly oriented in the bore so that the legs do not cover the windows.

17. The apparatus of claim 16, wherein the keyed extension comprises first and second members, the first member longer than the second member.

18. A liquid dispensing apparatus, comprising:

a) a container for holding a viscous liquid product to be dispensed, the container having an outlet;

b) a docking station for receiving the container, the docking station having a support for holding the container;

c) a reservoir for receiving the viscous liquid product from the container, the reservoir having an inlet and an outlet;

d) a docking cup operatively connected to the docking station, the docking cup having an inlet adapted to receive the outlet of the container and the docking cup having an outlet operatively connected to the inlet of the reservoir, the docking cup having a fitment engagement member;

e) a fitment operatively connected in the outlet of the container, the fitment comprising:

i) a cylindrical body having an inner wall defining a cylindrical bore having a first closed end and a second open end, the open end proximate the container outlet;

ii) an aperture formed in the body, the aperture in fluid communication with the viscous liquid product to be dispensed;

iii) a plunger having a cylindrical body slidable within the fitment cylindrical body and moveable between a closed position and dispensing position; and iv) a probe engaging member operatively connected to the cylindrical plunger body, the probe member positioned whereby there is an unobstructed flow path for the viscous liquid from the container, through the aperture and through the bore to the inlet of the reservoir, wherein placing the container on the docking cup moves the plunger from the closed position to the open position allowing the viscous product to be dispensed; and f) a biasing member positioned between the plunger and the closed end, thereby biasing the plunger in the closed position.

19. The apparatus of claim 18, the aperture comprises first and second windows generally opposite each other on the cylindrical body.

20. The apparatus of claim 19, the probe engaging member comprises first and second legs, generally opposite each other and oriented to be positioned between the windows.

21. The apparatus of claim 20, wherein the legs have a width that is less than a distance between the window, whereby the windows are unobstructed.

22. The apparatus of claim 21, further comprising a keyed extension extending from the closed end of the bore and a mating keyway formed in the plunger, wherein the plunger is properly oriented in the bore so that the legs do not cover the windows.

23. The apparatus of claim 22, wherein the keyed extension comprises first and second members, the first member longer than the second member.

* * * * *